US005466567A

United States Patent [19]

Anderson et al.

[11] Patent Number: 5,466,567

[45] Date of Patent: Nov. 14, 1995

[54] IMAGING ELEMENT COMPRISING AN ELECTRICALLY-CONDUCTIVE LAYER CONTAINING CONDUCTIVE FINE PARTICLES, A FILM-FORMING HYDROPHILIC COLLOID AND PRE-CROSSLINKED GELATIN PARTICLES

[75] Inventors: Charles C. Anderson; Yongcai Wang, both of Penfield; James L. Bello, Rochester; Ibrahim M. Shalhoub, Pittsford; Douglas D. Corbin, Rochester, all of N.Y.

[73] Assignee: Eastman Kodak Company, Rochester, N.Y.

[21] Appl. No.: 330,409

[22] Filed: Oct. 28, 1994

[51] Int. Cl.[6] ..... G03C 1/85

[52] U.S. Cl. ..... 430/530; 430/527; 430/539; 430/640; 430/63; 430/271; 430/537

[58] Field of Search ..... 430/527, 530, 430/537, 539, 640, 63, 271

[56] References Cited

U.S. PATENT DOCUMENTS

| | | | |
|---|---|---|---|
| 4,275,103 | 6/1981 | Tsubusaki et al. | 430/67 |
| 4,495,276 | 1/1985 | Takimoto et al. | 430/527 |
| 5,066,572 | 11/1991 | O'Connor et al. | 430/537 |
| 5,122,445 | 6/1992 | Ishigaki | 430/523 |
| 5,248,558 | 9/1993 | Bagchi | 430/539 |
| 5,340,676 | 8/1994 | Anderson et al. | 430/527 |
| 5,368,995 | 11/1994 | Christian et al. | 430/530 |
| 5,374,498 | 12/1994 | Fujita et al. | 430/539 |

*Primary Examiner*—Thomas R. Neville
*Attorney, Agent, or Firm*—Alfred P. Lorenzo

[57] ABSTRACT

Imaging elements, such as photographic, electrostatographic and thermal imaging elements, are comprised of a support, an image-forming layer and an electrically-conductive layer comprising a film-forming hydrophilic colloid having dispersed therein both electrically-conductive fine particles and pre-crosslinked gelatin particles. The combination of hydrophilic colloid, electrically-conductive fine particles and pre-crosslinked gelatin particles provides a controlled degree of electrical conductivity and beneficial chemical, physical and optical properties which adapt the electrically-conductive layer for such purposes as providing protection against static or serving as an electrode which takes part in an image-forming process.

20 Claims, No Drawings

IMAGING ELEMENT COMPRISING AN ELECTRICALLY-CONDUCTIVE LAYER CONTAINING CONDUCTIVE FINE PARTICLES, A FILM-FORMING HYDROPHILIC COLLOID AND PRE-CROSSLINKED GELATIN PARTICLES

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to electrically-conductive layers containing conductive fine particles, a film-forming hydrophilic colloid and pre-crosslinked gelatin particles and to the use of such electrically-conductive layers in imaging elements for such purposes as providing protection against the generation of static electrical charges or serving as an electrode which takes part in an image-forming process.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 μm in size in an insulating film-forming binder, exhibiting a surface resistance of $10^2$ to $10^{11}$ ohms per square The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{-1}cm^{-1}$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vandium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.1–10 g/$m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive fine particles in an electro-conductive coating to achieve effective antistatic performance results in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Particularly preferred electrically-conductive layers which are especially advantagerous for use in imaging elements and are capable of effectively meeting the stringent optical requirements of silver halide photographic elements are layers comprising a dispersion in a film-forming binder of fine particles of an electronically-conductive metal antimonate as described in copending commonly assigned U.S. patent application Ser. No. 231,218, filed Apr. 22, 1994, "Imaging Element Comprising An Electrically-Conductive Layer Containing Particles Of A Metal Antimonate" by Paul A. Christian and Charles C. Anderson and issued Nov. 29, 1994, as U.S. Pat. No. 5,368,995. For use in imaging elements, the average particle size of the electrically-conductive metal antimonate is preferably less than about one micrometer and more preferably less than about 0.5 micrometers. For use in imaging elements where a high degree of transparency is important, it is preferred to use colloidal particles of an electronically-conductive metal antimonate, which typically have an average particle size in the range of 0.01 to 0.05 micrometers. The preferred metal antimonates have rutile or rutile-related crystallographic structures and are represented by either Formula (I) or Formula (II) below:

$$M^{+2}Sb^{+5}{}_2O_6 \quad (I)$$

where $M^{+2}$=$Zn^{+2}$, $Ni^{+2}$, $Mg^{+2}$, $Fe^{+2}$, $Cu^{+2}$, $Mn^{+2}$, $Co^{+2}$ $$M^{+3}Sb^{+5}O_4 \quad (II)$$

where $M^{+3}$=$In^{+3}$, $Al^{+3}$, $Sc^{+3}$, $Cr^{+3}$, $Fe^{+3}$, $Ga^{+3}$.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antisbatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

Anderson et al, U.S. Pat. No. 5,340,676, issued Aug. 23, 1994, describes conductive layers comprising electrically-conductive fine particles, a film-forming hydrophilic colloid, and water-insoluble polymer particles. Representative polymer particles described include polymers and interpolymers of styrene, styrene derivatives, alkyl acrylates or alkyl methacrylates and their derivatives, olefins, vinylidene chloride, acrylonitrile, acrylamide and methacrylamide derivatives, vinyl esters, vinyl ethers, or condensation polymers such as polyurethanes and polyesters. The use of a mixed binder comprising the water-insoluble polymer particles mentioned above in combination with a hydrophilic colloid such as gelatin provides a conductive layer that requires a lower volume percentage of conductive fine particles compared with a layer obtained from a coating composition comprising the conductive fine particles and hydrophilic colloid alone. As disclosed in the '676 patent, it is believed that the electrically-conductive layer described therein is able to provide improved conductivity at a reduced volume percentage of the electrically-conductive fine particles by virtue of the action of the water-insoluble polymer particles in promoting chaining of the electrically-conductive fine particles into a conductive network.

While U.S. Pat. No. 5,340,676 represents a major advance in the art of providing electrically-conductive layers suitable for use in imaging elements, the use of the water-insoluble polymer particles described therein can result in less than optimum adhesion when hydrophilic colloid layers such as photographic emulsion or curl control layers are applied over the electrically-conductive layer.

It is toward the objective of providing an improved electrically-conductive layer, which like that of U.S. Pat. No. 5,340,676 provides high conductivity at low volumetric percentages of electrically-conductive fine particles and which also provides excellent adhesive characteristics for overlying hydrophilic colloid layers, that the present invention is directed.

SUMMARY OF THE INVENTION

In accordance with this invention, an imaging element for use in an image-forming process comprises a support, an image-forming layer, and an electrically-conductive layer; the electrically-conductive layer comprising electrically-conductive fine particles, a film-forming hydrophilic colloid and pre-crosslinked gelatin particles.

The gelatin particles used herein are pre-crosslinked gelatin particles, by which is meant that they are crosslinked before being introduced into the coating composition from which the electrically-conductive layer is formed. The pre-crosslinked gelatin particles utilized in this invention are pre-crosslinked to a degree at which they are substantially insoluble in an aqueous solution of a hydrophilic colloid. The word "particles" as used herein is intended to encompass any shape whatsoever as the particular shape of the particles is not critical.

In this invention, it is not feasible to crosslink the gelatin particles after the electrically-conductive layer has been coated since if particles of dried but non-crosslinked gelatin were incorporated in an aqueous hydrophilic colloid solution, they would tend to dissolve. It is, in fact, preferred that the pre-crosslinked gelatin particles utilized in this invention be particles of rather highly crosslinked gelatin so that very little swelling of these particles occurs.

In contrast with the mixed binder of U.S. Pat. No. 5,340,676 which is comprised of water-insoluble polymer particles such as polymethylmethacrylate particles and a film-forming hydrophilic colloid such as gelatin, the mixed binder of the present invention exhibits improved comparability since both the film-former and the particles are composed of a hydrophilic colloid. The combination of electrically-conductive fine particles, film-forming hydrophilic colloid and pre-crosslinked gelatin particles provides highly conductive coatings with low volume percentages of conductive fine particles and improved solution compatability compared with the coating compositions of U.S. Pat. No. 5,340,676. Thus, electrically-conductive layers of high transparency that are free of objectionable brittleness are readily obtained. Moreover, these layers strongly adhere to underlying and overlying layers such as photographic support materials and hydrophilic colloid layers.

The combination of electrically-conductive fine particles, film-forming hydrophilic colloid and pre-crosslinked gelatin particles provides a controlled degree of electrical conductivity and beneficial chemical, physical and optical properties which adapt the electrically-conductive layer for such purposes as providing protection against static or serving as an electrode which takes part in an image-forming process. Comparable properties cannot be achieved by using only the combination of electrically-conductive fine particles and film-forming hydrophilic colloid or the combination of electrically-conductive fine particles and pre-crosslinked gelatin particles. Thus, all three of the components specified are essential to achieving the desired results.

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly(ethylene terephthalate) as described in U.S. Pat. No. 3,245,833, (f) electrically conducting salts such as described in U.S. Pat. No. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, Research Disclosure, Jun. 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal,* Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography,* (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. No. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include an electrically-conductive layer comprising electrically-conductive fine particles, a film-forming hydrophilic colloid and pre-crosslinked gelatin particles.

The use of film-forming hydrophilic colloids in imaging elements is very well known. The most commonly used of these is gelatin and gelatin is a particularly preferred material for use in this invention as the film-forming hydrophilic colloid.

Hydrophilic colloids that are useful in the electrically-conductive layer of this invention are the same as are useful in silver halide emulsion layers, some of which have been described hereinabove. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The electrically-conductive fine particles utilized in this invention can be of a wide variety of types as long as they are of suitable size and have a sufficient degree of electrical conductivity for the purposes of this invention. Preferably the electrically-conductive fine particles are metal-containing particles. However, conductive polymer particles can be used in place of metal-containing particles if desired. Examples of useful conductive polymer particles include crosslinked vinyl benzyl quaternary ammonium polymer particles as described in U.S. Pat. No. 4,070,189 and the conductive materials described in U.S. Pat. Nos. 4,237,174, 4,308,332 and 4,526,706 in which a cationically stabilized latex particle is associated with a polyaniline acid addition salt semiconductor.

Any of the wide diversity of electrically-conductive metal-containing particles proposed for use heretofore in imaging elements can be used in the electrically-conductive layer of this invention. Examples of useful electrically-conductive metal-containing particles include donor-doped metal oxides, metal oxides containing oxygen deficiencies, and conductive nitrides, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN and ZrC.

Particular preferred metal oxides for use in this invention are antimony-doped tin oxide, aluminum-doped zinc oxide and niobium-doped titanium oxide.

In a particularly preferred embodiment of the present invention, the electrically-conductive fine particles are particles of an electronically-conductive metal antimonate as described in copending commonly assigned U.S. patent application Ser. No. 231,218 which is discussed hereinabove.

In the imaging elements of this invention, the electrically-conductive fine particles preferably have an average particle size of less than one micrometer, more preferably of less than 0.3 micrometers, and most preferably of less than 0.1 micrometers. It is also advantageous that the electrically-conductive fine particles exhibit a powder resistivity of $10^5$ ohm-centimeters or less.

It is an important feature of this invention that it permits the achievement of high levels of electrical conductivity with the use of relatively low volumetric fractions of the electrically-conductive fine particles. Accordingly, in the imaging elements of this invention, the electrically-conductive fine particles preferably constitute about 10 to about 50 volume percent of the electrically-conductive layer. Use of significantly less than 10 volume percent of the electrically-conductive fine particles will not provide a useful degree of electrical conductivity. On the other hand, use of significantly more than 50 volume percent of the electrically-conductive fine particles defeats the objectives of the invention in that it results in reduced transparency due to scattering losses and in brittle layers which are subject to cracking and exhibit poor adherence to the support material. It is especially preferred to utilize the electrically-conductive fine particles in an amount of from 15 to 35 volume percent of the electrically-conductive layer.

The gelatin utilized to form the pre-crosslinked gelatin particles can be any of the types of gelatin described hereinabove. The gelatin can be crosslinked through the use of a conventional gelatin hardening agent as described in *Research Disclosure*, Number 365, Item 36544, September, 1994. Such hardeners include, for example, formaldehyde and free dialdehydes such as glutaraldehyde, blocked aldehydes such as 2,3-dihydroxy-1,4-dioxane, aziridines, triazines, vinyl sulfones, epoxides, and others. The gelatin fine particles can be prepared by a variety of methods. Gelatin crosslinked in aqueous solution can be dried to give a solid powder which can be milled to a fine particle in either aqueous or non-aqueous solvent using conventional particle size reduction methods, for example, media milling, sand milling, attrition milling or ball milling. Gelatin crosslinked in aqueous solution can be spray dried to a fine powder using conventional spray drying equipment and then redispersed in aqueous media in the presence of a surfactant. Alternatively, gelatin dissolved in aqueous solution can be emulsified in a non-water miscible solvent, crosslinked by addition of an appropriate hardener, and then dried to obtain the fine gelatin particles. These can then be redispersed into water in the presence of a surfactant.

To perform their function of promoting chaining of the electrically-conductive fine particles into a conductive network at low volume fractions it is essential that the pre-crosslinked gelatin particles be of very small size. Particularly useful pre-crosslinked gelatin particles are those having an average particle size of from about 10 to about 1000 nanometers, while preferred pre-crosslinked gelatin particles are those having an average particle size of from 20 to 500 nanometers.

In addition to the electrically-conductive fine particles, film-forming hydrophilic colloid and pre-crosslinked gelatin particles, the electrically-conductive layer can optionally contain wetting aids, lubricants, matte particles, biocides, dispersing aids, hardeners and antihalation dyes. The electrically-conductive layer is applied from an aqueous coating formulation that is preferably formulated to give a dry coating weight in the range of from about 100 to about 1500 $mg/m^2$.

Incorporation in the electrically-conductive layer of pre-crosslinked gelatin particles of very small size, as described herein, is of particular benefit with electrically-conductive fine particles that are more or less spherical in shape. It is of less benefit with electrically-conductive fine particles that are fibrous in character, since fibrous particles are much more readily able to form a conductive network without the aid of the gelatin particles.

It is important that the pre-crosslinked gelatin particles be utilized in an effective amount in relation to the amount of hydrophilic colloid employed. Useful amounts are from about 0.3 to about 8 parts per part by weight of the film-forming hydrophilic colloid, while preferred amounts are from 0.5 to 5 parts per part by weight of the film-forming hydrophilic colloid, and particularly preferred amounts are from 0.5 to 3 parts per part by weight of the film-forming hydrophilic colloid. Use of too small an amount of the pre-crosslinked gelatin particles will prevent them from performing the desired function of promoting chaining of the electrically-conductive fine particles into a conductive network, while use of too large an amount of the pre-crosslinked gelatin particles will result in the formation of an electrically-conductive layer to which other layers of imaging elements may not adequately adhere.

In the electrically-conductive layer of this invention, the film-forming hydrophilic colloid forms the continuous phase and both the pre-crosslinked gelatin particles and the electrically-conductive fine particles are dispersed therein. As hereinabove described, all three of these ingredients are essential to achieving the desired result.

The electrically-conductive layer of this invention typically has a surface resistivity of less than $1\times10^{11}$ ohms/square, and preferably of less than $1\times10^{10}$ ohms/square.

One of the most difficult problems to overcome in using electrically-conductive layers in imaging elements is the tendency of layers which are coated over the electrically-conductive layer to seriously reduce the electro-conductivity. Thus, for example, a layer consisting of conductive tin oxide particles dispersed in gelatin will exhibit a substantial loss of conductivity after it is overcoated with other layers such as a silver halide emulsion layer or anti-curl layer. This loss in conductivity can be overcome by utilizing increased volumetric concentrations of tin oxide but this leads to less transparent coatings and serious adhesion problems. In marked contrast, the electrically-conductive layers of this invention, which contain pre-crosslinked gelatin particles, retain a much higher proportion of their conductivity after being overcoated with other layers.

Particularly useful imaging elements within the scope of this invention are those in which the support is a transparent polymeric film, the image-forming layer is comprised of silver halide grains dispersed in gelatin, the film-forming hydrophilic colloid in the electrically-conductive layer is gelatin, the electrically-conductive fine particles are colloidal particles of a metal antimonate, the electrically-conductive layer has a surface resistivity of less than $1\times10^{10}$ ohms/square and the electrically-conductive layer has a UV-density of less than 0,015.

An antistatic layer as described herein can be applied to a photographic film support in various configurations depending upon the requirements of the specific photographic application. In the case of photographic elements for graphics arts applications, an antistatic layer can be applied to a polyester film base during the support manufacturing process after orientation of the cast resin and coating thereof with a polymer undercoat layer. The antistatic layer can be applied as a subbing layer on the sensitized emulsion side of the support, on the side of the support opposite the emulsion or on both sides of the support. When the antistatic layer is applied as a subbing layer on the same side as the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion during film sensitizing. The antistatic layer would typically be located closest to the support. An intermediate layer, containing primarily binder and antihalation dyes functions as an antihalation layer. The outermost layer typically contains binder, matte, and surfactants and functions as a protective overcoat layer. The outermost layer can, if desired, serve as the antistatic layer. Additional addenda, such as polymer latexes to improve dimensional stability, hardeners or cross linking agents, and various other conventional additives as well as conductive particles can be present in any or all of the layers.

In the case of photographic elements for direct or indirect x-ray applications, the antistatic layer can be applied as a subbing layer on either side or both sides of the film support. In one type of photographic element, the antistatic subbing layer is applied to only one side of the support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, the film-forming hydrophilic colloid and the pre-crosslinked gelatin particles. This hybrid layer can be coated on one side of a film support under the sensitized emulsion.

The invention is further illustrated by the following examples of its practice.

Preparation of pre-crosslinked gelatin fine particles 85.2 g of lime-processed bone gelatin were added to 450 g of distilled water. The gel was allowed to swell for one hour and the mixture was heated at 45° C. 208 g of 1.8 wt % bis(vinyl methyl)sulfone solution in water and 7.5 g of 50 wt % trifunctional aziridine solution in ethanol were added and the solution stirred for several minutes. The mixture was refrigerated overnight to set the gelatin solution. The gelatinous solid was then sliced into small cubes and dried in an air oven at 35° C. until it was visually dry (about 6 hours). The dry gel was then kept at 21° C. and 80% RH for 24 hours and then heated at 105° C. for an additional 24 hours. The dried, crosslinked gelatin was broken into small pieces, dry ground to a particle size of about 50 μm, and then media milled in an aqueous slurry to an average particle size less than about 0.5 μm. The slurry of pre-crosslinked gelatin fine particles was used in the following examples.

Examples 1–5 and Comparative Examples A–H

Antistat coatings comprising electrically-conductive fine particles and gelatin binder were coated onto 4 mil thick polyethylene terephthalate film support that had been subbed with a terpolymer latex of acrylonitrile, vinylidene chloride, and acrylic acid. The aqueous coating formulations comprising about 2 weight % total solids were dried at 120° C. to give dried coating weights of 500 mg/m$^2$. The coating formulations contained 0.5 to 1.5 weight % of conductive tin oxide particles (doped with 6% antimony) with an average particle size of about 50 nm, 0.5 to 1.5 weight % of a gelatin binder comprising a mixture of pre-crosslinked gelatin fine particles and water-soluble gelatin, 0.02 weight % of 2,3-dihydroxy-1,4-dioxane gelatin hardener, and 0.01 weight % of a nonionic wetting aid (Olin 10G made by Olin Chemical Co.).

The surface resistivity of the coatings was measured at 20% relative humidity using a 2-point probe. The coating compositions and resistivities for the coatings are tabulated in Table 1. For purposes of comparison, results are also reported for Comparative Examples A to H in which either the tin oxide particles, the pre-crosslinked gelatin fine particles, or both were omitted or water-insoluble polymer particles described in U.S. Pat. No. 5,340,676 were used in place of the pre-crosslinked gelatin fine particles.

As shown by the data in Table 1, coatings of this invention provide excellent conductivity at much lower volume percent of the electrically-conductive particle than those comprising only water-soluble gelatin as the binder. For coatings comprising 15 volume % electrically-conductive particles, compositions of the present invention had resistivities three orders of magnitude superior compared with those containing only water-soluble gelatin as the binder and were also superior to those containing the water-insoluble polymer particles of U.S. Pat. No. 5,340,676.

TABLE 1

| Example No. | Binder | Volume % $SnO_2$ | Surface Resisitivity (Ω/square) |
|---|---|---|---|
| 1 | 2/1 pre-crosslinked gelatin particles/soluble gelatin | 15 | $3.1 \times 10^9$ |
| 2 | 2/1 pre-crosslinked gelatin particles/soluble gelatin | 35 | $3.1 \times 10^7$ |
| 3 | 3/2 pre-crosslinked gelatin particles/soluble gelatin | 5 | $1.0 \times 10^{14}$ |
| 4 | 3/2 pre-crosslinked gelatin particles/soluble gelatin | 15 | $6.3 \times 10^9$ |
| 5 | 3/2 pre-crosslinked gelatin particles/soluble gelatin | 35 | $5.0 \times 10^7$ |
| A | Water soluble gelatin only | 5 | $1.0 \times 10^{14}$ |
| B | Water soluble gelatin only | 15 | $8.0 \times 10^{12}$ |
| C | Water soluble gelatin only | 35 | $2.0 \times 10^9$ |
| D | Water soluble gelatin only | 0 | $1.0 \times 10^{14}$ |
| E | 2/1 pre-crosslinked gelatin particles/soluble gelatin | 0 | $1.0 \times 10^{14}$ |
| F | 3/2 polymer latex*/ water soluble gelatin | 5 | $1.0 \times 10^{14}$ |
| G | 3/2 polymer latex*/ water soluble gelatin | 15 | $1.0 \times 10^{11}$ |
| H | 3/2 polymer latex*/ water soluble gelatin | 35 | $2.0 \times 10^8$ |

*-styrene/n-butyl methacrylate/2-sulfoethyl methacrylate sodium salt (30/60/10) latex Examples 6–7 and Comparative Example I–J Conductive coatings were prepared in the aforementioned manner and these were then overcoated with a gelatin coating containing bis(vinyl methyl)sulfone hardener in order to simulate overcoating with a photographic emulsion or curl control layer. This gelatin layer was chill set at 15° C. and dried at 40° C. to give a dried coating weight of 4500 mg/m$^2$.

The internal resistivity of the overcoated samples was measured at 20% relative humidity using the salt bridge method described in R. A. Elder, "Resistivity Measurements on Buried Conductive Layers", EOS/ESD Symposium Proceedings, September 1990, pp. 251–254. Dry adhesion of the gelatin overcoat to the conductive layer was determined by scribing small hatch marks in the coating with a razor blade, placing a piece of high tack tape over the scribed area and then quickly pulling the tape from the surface. The amount of the scribed area removed is a measure of the dry adhesion. Wet adhesion for the samples was tested by placing the test samples in developing and fixing solutions at 35° C. each and then rinsing in distilled water. While still wet, a one millimeter wide line was scribed in the gelatin overcoat layer and a finger was rubbed vigorously across the scribe line. The width of the line after rubbing was compared to that before rubbing to give a measure of wet adhesion. The description of the samples and the results obtained are reported in Table 2.

As indicated in Table 2 use of pre-crosslinked gelatin fine particles in combination with water-soluble gelatin gave excellent electro-conductive properties before and after a gelatin overcoat was applied. It also gave excellent wet and dry adhesion to the overcoat layer. Comparative Example I in which only water-soluble gelatin was used in the coating formulation as the binder for the electrically-conductive particle gave unacceptable electro-conductive properties after overcoating. In Comparative Example I, a gelatin hardener, 2,3-dihydroxy-1,4-dioxane, was added to the coating formulation to crosslink the gelatin binder as the coating dried. However, using a binder that comprises only water-soluble gelatin that is crosslinked during the drying process does not provide the advantageous electro-conductive properties of the invention. In addition, the coatings of the present invention provide further improvements with respect to both electro-conductive properties after overcoating and wet adhesion to an overlying layer compared to the compositions described in U.S. Pat. No. 5,340,676 as can be seen by comparison of Example 7 of the present invention and Comparative Example J.

TABLE 2

| Example No. | Conductive Layer Binder Composition | Vol % $SnO_2$ | Resistivity Before Overcoat Ω/square | Resistivity After Overcoat Ω/square | Wet Adhesion | Dry Adhesion |
|---|---|---|---|---|---|---|
| 6 | 2/1 pre-crosslinked gelatin/soluble gelatin | 35 | $3.1 \times 10^7$ | $3.1 \times 10^8$ | Excellent | Excellent |
| 7 | 3/2 pre-crosslinked gelatin/soluble gelatin | 35 | $5.0 \times 10^7$ | $5.0 \times 10^7$ | Excellent | Excellent |
| I | Water soluble gelatin only | 35 | $2.0 \times 10^9$ | $1.0 \times 10^{14}$ | Excellent | Excellent |
| J | 3/2 polymer latex*/ water soluble gelatin | 35 | $2.0 \times 10^8$ | $1.2 \times 10^9$ | Good | Excellent |

*styrene/n-butyl methacrylate/2-sulfoethyl methacrylate sodium salt (30/60/10) latex The imaging elements of this invention exhibit many advantages in comparison with similar imaging elements known heretofore. For example, because they are able to utilize relatively low concentrations of the electrically-conductive fine particles they have excellent transparency characteristics and they are free from the problems of excessive brittleness and poor adhesion that have plagued similar imaging elements in the prior art. Their adhesion properties are particularly excellent because both components of the binder system are hydrophilic colloids and thus are compatible with the hydrophilic colloids commonly used in other layers of imaging elements. Also, because they are able to employ electrically-conductive fine particles of very small size they avoid the problems caused by the use of fibrous particles of greater size, such as increased light scattering and the formation of hazy coatings. It has been proposed heretofore to incorporate non-conductive auxiliary fine particles such as oxides, sulfates or carbonates in electrically-conductive layers comprised of metal-containing particles dispersed in a binder (see for example, U.S. Pat. No. 4,495,276). However, the use of auxiliary fine particles of high refractive index in an effort to reduce the amount of electrically-conductive metal-containing particle employed is not beneficial since it will result in the formation of a hazy, high minimum density coating. Moreover, the layer will be brittle and subject to cracking. It has also been proposed heretofore to utilize the combination of a binder, such as a hydrophilic colloid, an electrically-conductive metal oxide particle, such as doped tin oxide, and an electro-conductive polymer such as poly(sodium styrene sulfonate) or other polyelectrolyte (see for example, U.S. Pat. Nos. 4,275,103 and 5,122,445). However, water-soluble polymers, such as polyelectrolytes, do not significantly reduce the volume fraction of electrically-conductive metal-containing particles needed for good conductivity. This is especially the case at low humidity where polyelectrolytes contribute little to conductivity. Combining a water-soluble polymer such as polyacrylamide, hydroxyethyl cellulose, polyvinyl pyrrolidine or polyvinyl alcohol with gelatin yields results that are no different than using gelatin alone. Thus, it is a key feature of the present invention to utilize pre-crosslinked gelatin particles in an amount effective to permit the use of low volumetric concentrations of the electrically-conductive fine particles.

Similar results to those described in the above examples can be obtained by using hydrophilic colloids other than gelatin, by using pre-crosslinked gelatin particles other than those specifically described, and by using electrically-conductive fine particles other than antimony-doped tin oxide.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer, and an electrically-conductive layer; said electrically-conductive layer comprising electrically-conductive fine particles, a film-forming hydrophilic colloid and pre-crosslinked gelatin particles.

2. An imaging element as claimed in claim 1, wherein said electrically-conductive fine particles are polymer particles.

3. An imaging element as claimed in claim 1, wherein said electrically-conductive fine particles are metal-containing particles.

4. An imaging element as claimed in claim 1, wherein said film-forming hydrophilic colloid is gelatin.

5. An imaging element as claimed in claim 1, wherein said electrically-conductive fine particles have an average particle size of less than 0.3 micrometers.

6. An imaging element as claimed in claim 1 wherein said electrically-conductive fine particles constitute 15 to 35 volume percent of said electrically-conductive layer.

7. An imaging element as claimed in claim 1, wherein said electrically-conductive fine particles exhibit a powder resistivity of $10^5$ ohm-centimeters or less.

8. An imaging element as claimed in claim 1, wherein said pre-crosslinked gelatin particles have an average particle size of from about 10 to about 1000 nanometers.

9. An imaging element as claimed in claim 1, wherein said pre-crosslinked gelatin particles have an average particle size of from 20 to 500 nanometers.

10. An imaging element as claimed in claim 1, wherein said pre-crosslinked gelatin particles are present in said electrically-conductive layer in an amount of from 0.5 to 3 parts per part by weight of said film-forming hydrophilic colloid.

11. An imaging element as claimed in claim 1, wherein said electrically-conductive layer has a dry weight coverage of from about 100 to about 1500 $mg/m^2$.

12. An imaging element for use in an image-forming process; said imaging element comprising a support, an image-forming layer, and an electrically-conductive layer; said electrically-conductive layer comprising a film-forming hydrophilic colloid having dispersed therein both electrically-conductive metal-containing particles and pre-crosslinked gelatin particles; said electrically-conductive metal-containing particles having an average particle size of less than 0.3 micrometers and constituting about 10 to about 50 volume percent of said electrically-conductive layer, and said pre-crosslinked gelatin particles having an average particle size of from about 10 to about 1000 nanometers and being present in said electrically-conductive layer in an amount of from about 0.3 to about 8 parts per part by weight of said film-forming hydrophilic colloid.

13. An imaging element as claimed in claim 12, wherein said electrically-conductive metal-containing particles are doped metal oxides.

14. An imaging element as claimed in claim 12, wherein said electrically-conductive metal-containing particles are metal oxides containing oxygen deficiencies.

15. An imaging element as claimed in claim 12, wherein said electrically-conductive metal-containing particles are metal nitrides, carbides or borides.

16. An imaging element as claimed in claim 12, wherein said electrically-conductive metal-containing particles are particles of antimony-doped tin oxide.

17. An imaging element as claimed in claim 12, wherein said electrically-conductive metal-containing particles are particles of aluminum-doped zinc oxide.

18. An imaging element as claimed in claim 12, wherein said electrically-conductive metal-containing particles are particles of niobium-doped titanium oxide.

19. An imaging element as claimed in claim 12, wherein said electrically-conductive metal-containing particles are colloidal particles of a metal antimonate.

20. A photographic film comprising:

(1) a support;

(2) an electrically-conductive layer which serves as an antistatic layer overlying said support; and (3) a silver halide emulsion layer overlying said electrically-conductive layer; said electrically-conductive layer comprising a film-forming hydrophilic colloid having dispersed therein both electrically-conductive metal-containing particles and pre-crosslinked gelatin particles; said electrically-conductive metal-containing particles having an average particle size of less than 0.3 micrometers and constituting about 10 to about 50 volume percent of said electrically-conductive layer, and said pre-crosslinked gelatin particles having an average particle size of from about 10 to about 1000 nanometers and being present in said electrically-conductive layer in an amount of from about 0.3 to about 8 parts per part by weight of said film-forming hydrophilic colloid.

* * * * *